US009474337B2

(12) United States Patent
Violato

(10) Patent No.: US 9,474,337 B2
(45) Date of Patent: Oct. 25, 2016

(54) FEMALE COMPONENT OF A PRESS STUD, A METHOD FOR THE MANUFACTURE THEREOF, AND A PRESS STUD INCLUDING THIS FEMALE COMPONENT

(71) Applicant: Ernesto Violato, Piove di Sacco (IT)

(72) Inventor: Ernesto Violato, Piove di Sacco (IT)

(73) Assignee: RIRI S.A., Mendrisio (CH)

( * ) Notice: Subject to any disclaimer, the term of this patent is extended or adjusted under 35 U.S.C. 154(b) by 19 days.

(21) Appl. No.: 14/058,821

(22) Filed: Oct. 21, 2013

(65) Prior Publication Data

US 2014/0109352 A1 Apr. 24, 2014

(30) Foreign Application Priority Data

Oct. 22, 2012 (IT) ..... BO2012A0574

(51) Int. Cl.
*A44B 17/00* (2006.01)

(52) U.S. Cl.
CPC ..... *A44B 17/0076* (2013.01); *A44B 17/0017* (2013.01); *A44B 17/0041* (2013.01); *A44D 2203/00* (2013.01); *Y10T 24/32* (2015.01); *Y10T 24/45775* (2015.01); *Y10T 29/49826* (2015.01)

(58) Field of Classification Search
CPC ..... A44B 17/0076; A44B 17/0064; A44B 17/0011; A44B 17/00; A44B 17/047; A44B 17/0023; A44B 17/0041; A44B 17/0017; A44B 17/0052; A44D 2203/00; Y10T 24/45775; Y10T 24/32
See application file for complete search history.

(56) References Cited

U.S. PATENT DOCUMENTS

| | | | | |
|---|---|---|---|---|
| 5,259,096 | A * | 11/1993 | Grant | 24/324 |
| 6,067,694 | A | 5/2000 | Candotti | |
| 6,170,129 | B1 | 1/2001 | Pferdehirt | |
| 2006/0005363 | A1 | 1/2006 | Reiter | |
| 2009/0155015 | A1* | 6/2009 | Parisi | B60N 3/046 411/172 |
| 2011/0016679 | A1* | 1/2011 | Candotti | A44B 17/0011 24/700 |
| 2011/0041295 | A1 | 2/2011 | Reiter | |

FOREIGN PATENT DOCUMENTS

| | | |
|---|---|---|
| EP | 2 401 934 A1 | 1/2012 |
| WO | WO 97/15207 | 5/1997 |

OTHER PUBLICATIONS

Italy Search Report issued in Italy Application No. BO2012A000574 with English translation of categories of cited documents dated Jul. 5, 2013 (8 pages).

* cited by examiner

*Primary Examiner* — Robert J Sandy
*Assistant Examiner* — Michael Lee
(74) *Attorney, Agent, or Firm* — Flynn, Thiel, Boutell & Tanis, P.C.

(57) ABSTRACT

A female component of a press stud including a monolithic body made by hot forming and defining a housing seat for a retaining member housed in the housing seat and intended to lock a corresponding male component in position selectively during use. A locking lip, integral with the monolithic body, extends from the housing seat and is deformed so as to partially close the housing seat in order to secure the retaining member therein. In order to produce the female component, the monolithic body is hot formed, and the locking lip is deformed after the introduction of the retaining member into the housing seat, by hot or cold crimping, upsetting or deformation in general.

10 Claims, 4 Drawing Sheets

FEMALE COMPONENT OF A PRESS STUD, A METHOD FOR THE MANUFACTURE THEREOF, AND A PRESS STUD INCLUDING THIS FEMALE COMPONENT

FIELD OF THE INVENTION

The present invention relates to the general field of press studs. While not being limited thereto, the invention has been devised with particular regard to a female component for a press stud, also known as a press fastener, to be fitted, for example, on a fabric flap in order to connect it to another fabric flap on which a corresponding male component has been fitted.

BACKGROUND OF THE INVENTION

There are various known press studs in which the female component comprises a cavity housing a magnet, a spring, a plastic ring or other retaining member for the purpose of securing, in use, a corresponding male component in connection with the female component, while still allowing it to be detached with a small degree of force.

These female components of press studs operate in the correct manner, but the manufacturing method, based on the cutting and bending of one or more metal sheets, limits the configurations that can be obtained. Purely by way of example, female components for press studs having square or polygonal outer profiles cannot be produced, except by means of complicated and costly operations which do not always give satisfactory results in terms of appearance. Furthermore, it is practically impossible to use the conventional techniques for manufacturing female components of press studs with complex profiles, such as star-shaped, knurled, or more generally scalloped profiles.

SUMMARY OF THE INVENTION

The object of the present invention is to provide a female component for a press stud which can be produced simply and economically, in configurations and shapes which may be complex, while maintaining an excellent capacity for connection to the male component by means of a retaining member housed and secured permanently in the female component.

In order to achieve the aforementioned objects, the present invention proposes a female component of a press stud comprising a monolithic body made by hot forming, defining a housing seat to accommodate a retaining member housed in the housing seat and intended to lock a corresponding male component in position during use, with a locking lip, integral with the monolithic body, extending from the housing seat and partially closing the housing seat to secure the retaining member therein.

A female component whose body is monolithic and produced by hot forming can offer a very considerable freedom of choice regarding the shape which can be produced, with benefits in relation to the creativity of designers and the demands of the fashion market. At the same time, the housing seat and the locking lip deformed so as to partially close the seat can securely house within the female component a retaining member capable of providing the technical functionality, in terms of the locking and release of the press stud, which is typical of press studs according to the prior art, produced by cutting and bending sheet metal.

Preferably, the retaining member is an elastically deformable member. More specifically, an annular plastic member may advantageously be used. In a variant, however, the retaining member has general properties of magnetic attraction.

Advantageously, the monolithic body and the locking lip integral therewith are made of plastic, or aluminium or an alloy thereof, or zinc or an alloy thereof such as brass or, more preferably, Zamak. The hot forming may include methods of hot moulding, injection or pressure casting, for example the injection of plastic material or Zamak, or hot pressing of brass.

The locking lip initially extends from the retaining member housing seat to allow the latter to be mounted in the monolithic body. The locking lip is then advantageously bent by crimping, upsetting or plastic deformation in general, preferably by a cold process, to partially close the housing seat, thus forming an annular edge which allows the retaining member to be secured in the housing seat.

The invention also relates to a press stud comprising a female component of the aforementioned type, interacting with a corresponding male component of a generally known type. The male component may also be made by hot forming, for example by the hot moulding, injection or pressure casting of aluminium or alloys thereof, zinc or alloys thereof, such as brass or Zamak, or plastic.

The present invention also relates to a method for producing a female component of a press stud, comprising the steps of:

- hot forming a monolithic body of a female component of a press stud, defining within it a housing seat from which there extends a locking lip which is integral with the monolithic body,
- inserting a retaining member into the housing seat,
- partially closing the housing seat by deforming the locking lip in order to secure the retaining member in the housing seat.

BRIEF DESCRIPTION OF THE DRAWINGS

Further characteristics and advantages of the invention will be made clear by the following detailed description of a preferred embodiment of the invention, which refers to the attached drawings, given purely by way of non-limiting example, in which.

DETAILED DESCRIPTION

Figure 1:
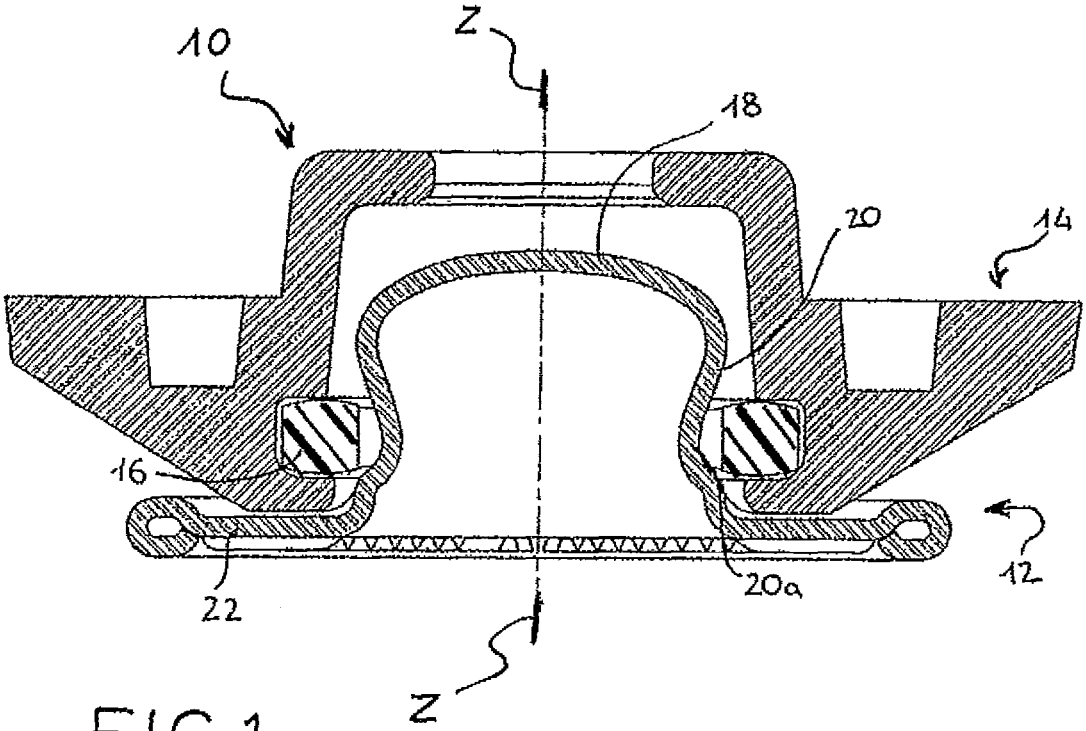
FIG. 1 is a longitudinal section through a press stud with a male component fastened to a female component according to the present invention.

With reference to FIG. 1, the reference numeral 10 indicates the whole of a press stud comprising a male component 12 engaged by a snapping action or by pressure in a female component 14, using an elastically deformable member which, in the specific example shown in the figures, is composed of an elastic ring 16, preferably made of plastic and preferably having a substantially polygonal shape. The characteristics of an elastic ring 16 of this type are, for example, those illustrated in the document WO 1997/15207 filed by the present applicant. Clearly, the type and shape of the elastically deformable member housed in the female component is not essential for the purposes of the present invention, and can therefore be varied widely, not being limited to the example shown in the appended drawings. For example, the elastically deformable member may be a metal split ring. The elastic ring 16 may also be replaced with another retaining member, for example a magnetic member, which may be non-annular, in which case the male component will have a known shape suitable for engagement with this magnetic member.

The male component 12 is inserted into the female component 14 in an axial direction Z-Z and is secured therein by the elastic ring 16. For this purpose, the male component 12, of a generally known type, comprises a base structure 22 from which a stem 20 projects, this stem terminating in a head 18. The stem 20 has a portion 20*a* of smaller diameter than that of the head 18, such that the elastic ring 16 engages elastically with this portion 20*a* in the closed configuration of the press stud 10, after the head 18 has been passed through it.

The base structure 22 of the male component 12 can be fixed, for example, to a flap of a garment by one of the methods known in the art, for example by sewing, riveting, stapling, gluing, or another known method. The shape of the male component 12 illustrated by way of example in FIG. 1 is not to be considered as limiting the present invention. For example, if the female component comprises a magnetic retaining member, the male component may be similar or identical to the female component described above, or, more generally, it is not necessary for a portion of the stem 20*a* to have a smaller diameter than the head 18.

Figure 2:
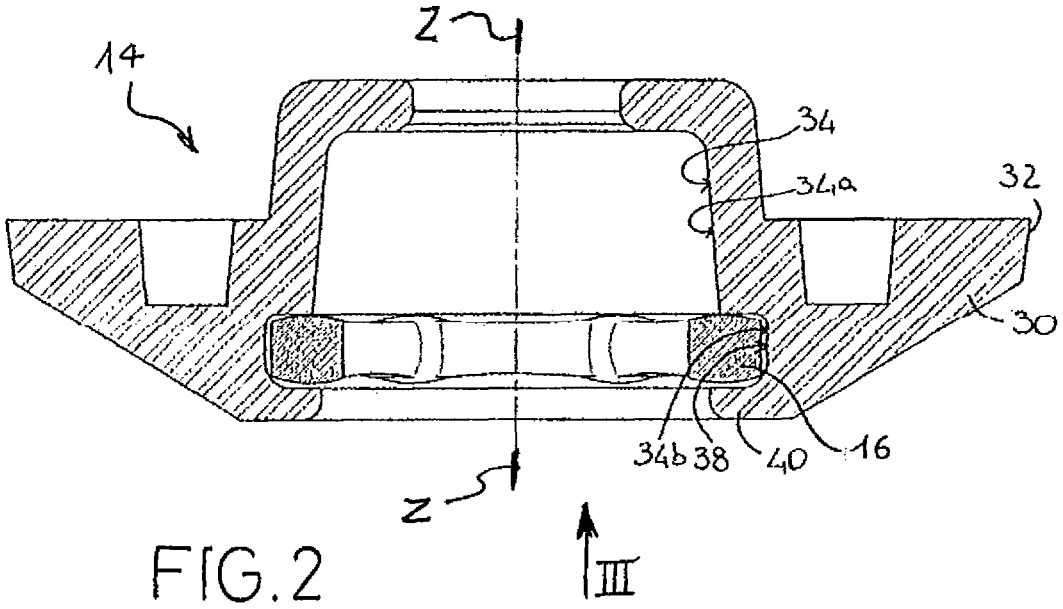
FIG. 2 is a longitudinal section through the female component of the press stud of FIG. 1.
Figure 3:
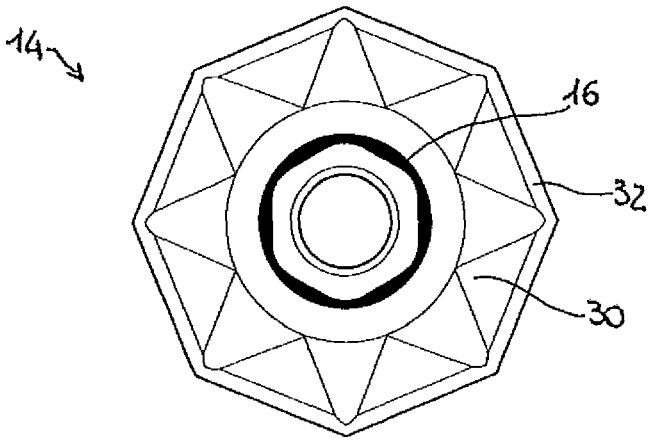
FIG. 3 is a plan view, taken in the direction of the arrow III, of the female component of FIG. 2.

Turning now to FIGS. 2 and 3, it can be seen that the female component 14 comprises a base structure formed by a monolithic body 30 with an external contour 32 which is, for example, polygonal. This shape has been selected purely as an illustration and example of the present invention and is not to be considered as limiting the innumerable possible shapes of the monolithic body 30, particularly its profile which is completely visible to a user, comprising both the lateral perimetric surface and portions of the front surface which are visible to the user, for example after the female component has been fitted to a garment or the like. The shape of the monolithic body 30 may be different from the illustrated polygonal shape, and may, for example, be round, square, elliptical, heart-shaped or star-shaped, or, more generally, may be scalloped or may have any imaginative or geometrical shape, whether symmetrical or otherwise.

In a substantially central area of the monolithic body 30, on the side opposite that which is to be placed in contact with a fabric or substrate, in other words on the side which is visible when the female component is fixed to a fabric or substrate, there is a cavity 34 which extends along the axis Z-Z. An inner portion 34*a* of the cavity is substantially cylindrical or preferably slightly flared to facilitate the forming of the female component during its production, and has a (maximum) diameter which is smaller than that of an outer annular portion 34*b* which acts as a housing seat 38 for the elastic ring 16. A locking lip 40, preferably annular and bent radially towards the axis Z-Z, secures the elastic ring 16, or other similar retaining member, in the housing seat 38.

The monolithic body 30 and the locking lip 40 of the female component are formed integrally with each other as one piece from a single material. In particular, they are not produced by the deformation of a sheet of metal, as in a known method for forming female components for press studs, but are produced by hot forming, for example by hot moulding, injection or pressure casting of metal or metal alloy, such as aluminium and its alloys, zinc and its alloys such as brass and Zamak, or plastic materials. The zinc alloys known as Zamak are particularly suitable for the application of the present invention, because they are easily workable and economical.

The female component 14 may also be formed from plastic, in which case the locking lip 40 is again formed integrally in one piece with the monolithic body 30. In this case, the forming method preferably includes the use of injection moulding for forming these parts.

Figure 4:
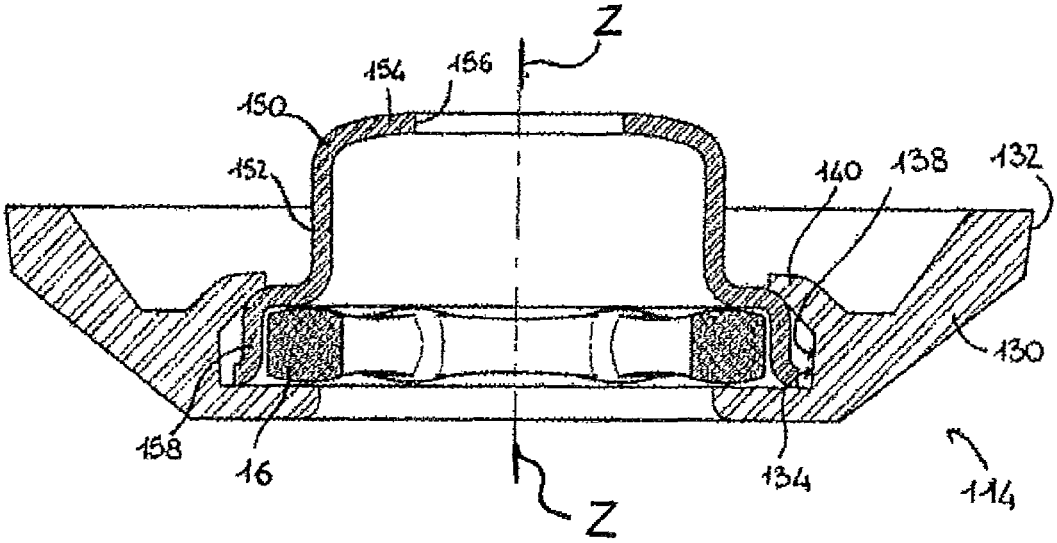
FIG. 4 shows a longitudinal section through a female component according to a variant of the present invention.

FIG. 4 shows a variant of the female component 114, with identical numbers indicating elements identical to those described above. The female component 114 comprises a base structure formed by a monolithic body 130 with an external contour 132 which is, for example, polygonal. As in the embodiment described above, the polygonal shape depicted here has been chosen purely as an illustration and example of the present invention, and is not to be considered as limiting.

In a substantially central area of the monolithic body 130, on the side to be placed in contact with a fabric or substrate, there is a cavity 134 which extends along the axis Z-Z. The cavity 134 acts as a housing seat 138 for a ring of elastic material 16 (or other similar retaining member) and for a cup-shaped body 150. The cup-shaped body 150 has a lateral wall 152 which is preferably substantially cylindrical, and a base 154 having a hole 156 for fixing the female component 114 to a fabric or other substrate. At the end opposite the base 154, the lateral wall 152 of the cup-shaped body 150 is extended in the form of an enlarged annular edge 158, having a greater diameter than the lateral wall 152, within which the elastic ring 16 is housed. A locking lip 140, which extends from the monolithic body 130 and is preferably annular, is bent towards the axis Z-Z and secures the ring of elastic material 16 and the edge 158 of the cup-shaped body 150 in the housing seat 138.

The monolithic body 130 and the locking lip 140 of the female component 114 are formed integrally with each other, in one piece, from a single material, while the cup-shaped body 150 is a separate element. In particular, the cup-shaped body is preferably produced by deformation of a metal sheet, while the monolithic body 130 is produced by the hot forming of metal, metal alloy or plastic, as described above for the monolithic body 30 of the first embodiment.

The female component 14, 114 is produced in successive processing steps. In a first step, a molten material (plastic or metal) is formed in a mould into a monolithic body 30, 130 having a locking lip 40', 140', as shown, respectively, in FIG. 5, which relates to the first embodiment of the female component 14, and in FIG. 6, which relates to the second embodiment of the female component 114. The locking lip 40', 140' extends around the edge of the cavity 34, 134 in the direction of the axis Z-Z, so that there are no undercut parts which would complicate the demoulding of the piece after the solidification of the molten material.

Figure 5:
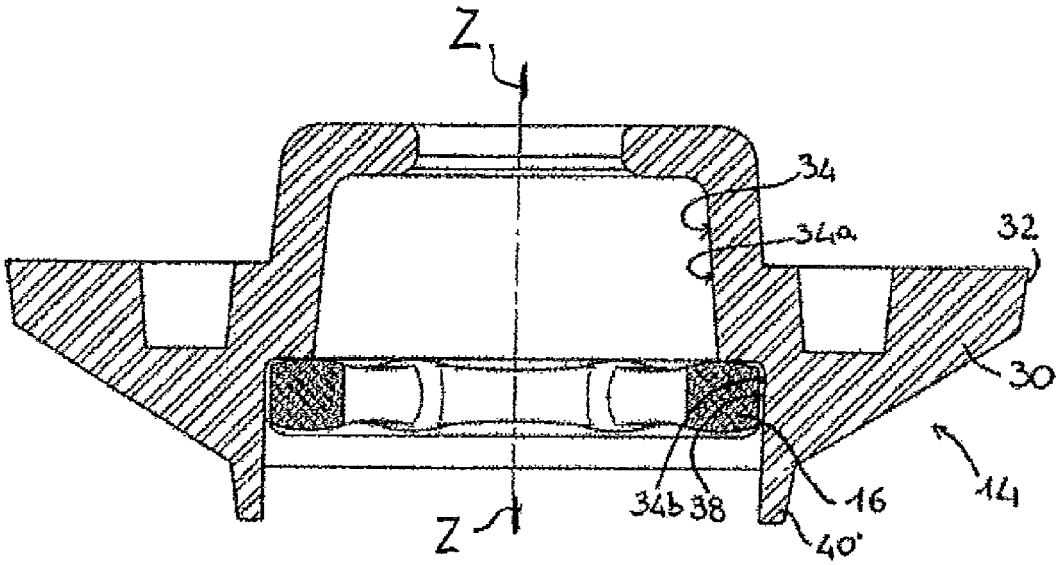
FIG. 5 shows a longitudinal section through the female component of FIG. 2 during the production process.

With reference to the first embodiment of FIG. 5, the open locking lip 40' of the female component 14 allows the ring of elastic material 16 or other retaining member to be inserted into the cavity 34. After insertion, the open locking lip 40' is deformed and bent towards the axis Z-Z, so as to assume the configuration of FIGS. 2 and 3, in which the final locking lip 40 partially closes the cavity and secures the elastic ring 16 therein.

Figure 6:
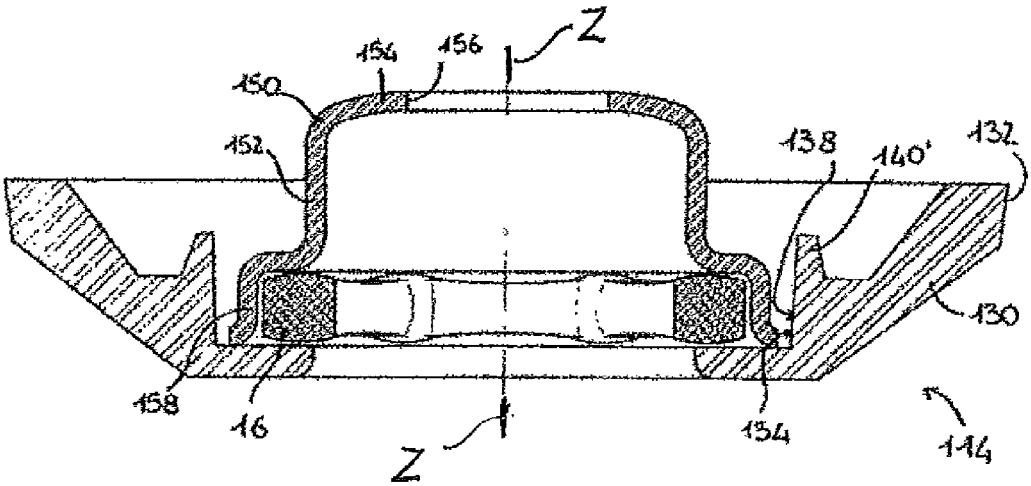
FIG. 6 shows a longitudinal section through the female component of FIG. 4 during the production process.

In the second embodiment, shown in FIG. 6, both the elastic ring 16 or other retaining member and the cup-shaped body 150 are inserted into the cavity 134 when the lip 140' is open. The open locking lip 140' is then deformed and bent towards the axis Z-Z, so as to assume the final configuration of FIG. 4, in which the final locking lip 140 partially closes the cavity 138 and secures the elastic ring 16 therein.

If the component is made of metallic material, then, depending on the dimensions and thickness of the locking lip 40, 40'; 140, 140', it is possible to carry out the operation by hot or cold crimping, upsetting or, more generally, deformation. On the other hand, if it is made of thermoplastic material, it is preferable to heat the component locally to make the lip sufficiently malleable to be deformed so as to partially close the housing cavity 134.

As mentioned above, the production process described here provides a simple and economical way of obtaining a component with a practically unlimited range of customization options in terms of the perimeter, designs, relief, processing, inserts, and the like, which would be impossible for a component made from a suitably formed sheet, owing to the limitations imposed by its processing.

Clearly, provided that the principle of the invention is retained, the forms of embodiment and the details of construction can be varied widely from what has been described and illustrated, without departure from the scope of the invention.

The invention claimed is:

1. A female component of a press stud comprising a monolithic body made by hot forming and defining a housing seat for a retaining member housed in the housing seat and intended to lock a corresponding male component in position selectively during use, with a locking lip, integral with the monolithic body, extending from the housing seat and deformed so as to partially close the housing seat to secure the retaining member therein, wherein the locking lip is deformed, after the hot forming of the monolithic body, by plastic deformation from an open position, in which the housing seat is open and free to receive the retaining member, to a closed position, in which the housing seat is partially closed and the retaining member is secured therein by means of the locking lip, wherein the retaining member is locked into the housing seat between the locking lip and a locking portion of the monolithic body, with the locking lip being on an opposite side of the retaining member than the locking portion, and further comprising a cup-shaped body having an annular edge abutting the locking lip to thereby lock both the cup-shaped body and the retaining member within the housing seat.

2. A female component of a press stud according to claim 1, wherein the housing seat for the retaining member is substantially cylindrical.

3. A female component of a press stud according to claim 1, wherein the retaining member is an elastically deformable annular plastic member.

4. A female component of a press stud according to claim 1, wherein the retaining member has characteristics of magnetic attraction.

5. A female component of a press stud according to claim 1, wherein the monolithic body and the locking lip integral therewith are made of a material selected from the group comprising aluminum and its alloys, zinc and its alloys, and plastic.

6. A female component of a press stud according to claim 5, wherein the monolithic body and the locking lip integral therewith are made of brass or Zamak.

7. A female component of a press stud according to claim 5, wherein the monolithic body is made by hot moulding, pressure casting or injection, the locking lip being bent by subsequent hot or cold crimping, upsetting or plastic deformation.

8. A female component of a press stud according to claim 1, wherein an end of the locking lip is connected to a base of the monolithic body at an area that has a greater thickness than the locking lip.

9. A press stud, comprising a female component and a male component which can be selectively locked within the female component, the female component comprising a monolithic body made by hot forming and defining a housing seat for a retaining member housed in the housing seat and intended to lock the male component in position selectively during use, a locking lip, integral with the monolithic body, extending from the housing seat and deformed so as to partially close the housing seat to secure the retaining member therein, wherein the locking lip is deformed, after the hot forming of the monolithic body, by plastic deformation from an open position, in which the housing seat is open and free to receive the retaining member, to a closed position, in which the housing seat is partially closed and the retaining member is secured therein by means of the locking lip, further comprising a cup-shaped body having an annular edge abutting the locking lip to thereby lock both the cup-shaped body and the retaining member within the housing seat.

10. A press stud according to claim 9, wherein an end of the locking lip is connected to a base of the monolithic body at an area that has a greater thickness than the locking lip.

* * * * *